US005795517A

United States Patent [19]

Heisler et al.

[11] Patent Number: 5,795,517

[45] Date of Patent: Aug. 18, 1998

[54] COLLECTION AND DEPOSITION OF CHOPPED FIBROUS STRANDS FOR FORMATION INTO NON-WOVEN WEBS OF BONDED CHOPPED FIBERS

[75] Inventors: Daniel F. Heisler, Brampton; Christopher J. Clements; Kenneth M. Berry, both of Guelph, all of Canada

[73] Assignee: Owens-Corning Canada, North York, Canada

[21] Appl. No.: 646,698

[22] Filed: May 3, 1996

[51] Int. Cl.[6] ..... C03B 37/16; D01G 1/04

[52] U.S. Cl. ..... 264/115; 264/121; 264/128; 425/82.1; 425/83.1

[58] Field of Search ..... 264/518, 115, 264/121, 128; 425/82.1, 83.1

[56] References Cited

U.S. PATENT DOCUMENTS

| | | | |
|---|---|---|---|
| 2,774,630 | 12/1956 | Henry et al. | 299/140 |
| 3,939,532 | 2/1976 | Wiegand . | |
| 4,060,355 | 11/1977 | Walz et al. | 425/7 |
| 4,140,450 | 2/1979 | Pfeifer et al. | 425/82.1 |
| 4,253,610 | 3/1981 | Larkin | 239/430 |
| 4,300,931 | 11/1981 | Phillips | 65/4.3 |
| 4,337,074 | 6/1982 | Muschelknautz et al. | 65/5 |
| 4,390,336 | 6/1983 | Ziegler | 425/82.1 |
| 4,419,117 | 12/1983 | Muschelknautz et al. | 65/16 |
| 4,466,819 | 8/1984 | Dunn | 65/4.4 |
| 4,496,384 | 1/1985 | Lin | 65/4.4 |
| 4,557,637 | 12/1985 | Barclay et al. | 406/153 |
| 4,600,423 | 7/1986 | Stotler et al. | 65/4.4 |
| 4,601,741 | 7/1986 | Stotler et al. | 65/4.4 |
| 5,093,059 | 3/1992 | Nathoo et al. | 264/121 |
| 5,274,892 | 1/1994 | Strahm | 26/20 |
| 5,368,623 | 11/1994 | Hirschmann et al. | 65/454 |
| 5,402,938 | 4/1995 | Sweeney | 239/431 |
| 5,407,135 | 4/1995 | Jeffs | 239/288 |

FOREIGN PATENT DOCUMENTS

| | | |
|---|---|---|
| 6285180 | 10/1994 | Japan . |
| 259018 | 5/1970 | U.S.S.R. . |
| 1675235 | 7/1991 | U.S.S.R. . |
| WO 95/13992 | 5/1995 | WIPO . |
| WO 96/02476 | 2/1996 | WIPO . |

*Primary Examiner*—Mary Lynn Theisen

*Attorney, Agent, or Firm*—C. Michael Gegenheimer; Inger H. Eckert

[57] ABSTRACT

An air cannon (100), formed by associating an inlet cone (116), an air amplifier (104) and an outlet cone (124) with one another, receives chopped fibers and forcefully deposits the chopped fibers on a collection surface (102) or web moving beyond an outlet end (126) of the outlet cone (124). A binder is applied to the resulting mat (172) of chopped fibers, the binder is activated by the application of energy with the resulting treated mat (182) being compacted, cooled and rolled up to form a chopped strand mat package (194). For wide mats, one or more banks (130) of air cannons (100) extend across the moving collection web. The air cannons (100) of each bank (130) are alternately directed up-line and down-line of the web to reduce interference between the air cannons (100) by means of L-shaped support rods (136) which have generally horizontal and generally vertical legs (136H, 136V) which are separated from one another by acute and obtuse angles (140, 142) for up-line and down-line direction, respectively. The air cannons (100) can also be individually adjusted to vary the aimed direction of the air cannons (100) across the web by rotation of the generally horizontal legs (136H) of the L-shaped support rods (136). The air cannons (100) forcefully direct chopped fibers to the web to overcome air turbulence within a forming hood (170) and forces due to static electricity.

23 Claims, 10 Drawing Sheets

COLLECTION AND DEPOSITION OF CHOPPED FIBROUS STRANDS FOR FORMATION INTO NON-WOVEN WEBS OF BONDED CHOPPED FIBERS

SPECIFICATION

TO ALL WHOM IT MAY CONCERN:

Be it known that we, DANIEL F. HEISLER, a citizen of Canada, resident of Brampton, Region of Peel, Ontario, Canada, CHRISTOPHER J. CLEMENTS, a citizen of Canada, resident of Guelph, County of Wellington, Ontario, Canada, and KENNETH M. BERRY, a citizen of Canada, resident of Guelph, County of Wellington, Ontario, Canada, have invented a new and useful improvement in COLLECTION AND DEPOSITION OF CHOPPED FIBROUS STRANDS FOR FORMATION INTO NON-WOVEN WEBS OF BONDED CHOPPED FIBERS, which invention is fully set forth in the following specification.

TECHNICAL FIELD

The present invention relates in general to the collection of chopped fibrous materials and, more particularly, to apparatus for collecting chopped fibers from a source of such fibers and depositing the chopped fibers on a collection surface to be processed into non-woven webs of bonded chopped fibrous materials commonly referred to as chopped strand mat. While the invention is generally applicable to a wide variety of fibrous materials including mineral and organic fibrous materials, it will be described herein with reference to glass fibers for which it is particularly applicable and initially being applied.

BACKGROUND OF THE INVENTION

Continuous strands of fibrous material, such as glass filaments, have been collected and distributed using opposed Coanda effect surfaces to produce mats of such material used, for example, for insulation. Examples of such equipment are disclosed in U.S. Pat. No. 4,300,931; U.S. Pat. No. 4,466,819; and, U.S. Pat. No. 4,496,384. Such continuous strands typically are handled wet since they are coated with binder or sizing which is sprayed or otherwise applied to the strands prior to the strands being passed to the Coanda effect surfaces.

Unlike these continuous fibers, chopped fibers are dry such that there can be a substantial build up of static electricity during their processing. Accordingly, when chopped fibers are handled, equipment for suppressing or dissipating static electricity is normally provided. Unfortunately, static suppression equipment adds expense to equipment handling dry chopped fibers and can cause problems of its own in terms of maintenance.

Even so, non-woven webs of bonded chopped glass, i.e., chopped strand mat, have been produced for many years. An initial step in that production is to collect the chopped glass and deposit it onto a moving collection surface with the resulting mat of chopped glass being processed to produce the chopped strand mat. Choppers are positioned over a forming hood which surrounds the collection surface with the choppers providing chopped glass to the forming hood through openings in the top of the hood to direct a chopped glass stream toward the collection surface. Air nozzles are angled into the glass stream in an attempt to disperse the glass stream.

The amount of glass strand input to each of the choppers is adjusted and the nozzles bent in an attempt to evenly distribute the chopped glass on the collection surface. The collection surface is foraminous and has air drawn through it to assist in the even distribution of the chopped glass and to draw the glass to the collection surface. Unfortunately, these efforts to achieve uniform fiber distribution on the collection surface are not always successful.

There is, thus, a need for improved apparatus for collecting chopped fibers from a source of such fibers and depositing the chopped fibers on a collection surface such that the chopped fibers are evenly distributed and thereby better able to be processed into chopped strand mat. Preferably, such apparatus would overcome problems with turbulent air flow in the forming hood and static electricity which are associated with existing chopped fiber handling.

SUMMARY OF THE INVENTION

This need is met by the methods and apparatus of the present invention wherein an inlet cone, an air amplifier and an outlet cone are associated with one another to form an air cannon which receives chopped fibers and forcefully deposits the chopped fibers on a collection surface or web moving beyond an outlet end of the outlet cone. A binder is applied to the resulting mat of chopped fibers, the binder may be activated by the application of energy such as heat with the resulting treated mat being compacted, cooled and rolled up to form a chopped strand mat package. For wide mats, one or more banks each made up of at least one and preferably a plurality of air cannons extend across the moving collection web. The air cannons of a bank containing a plurality of air cannons are preferably alternately directed up-line and down-line of the web to reduce interference between the air cannons which can also be individually adjusted to vary the aimed direction of the air cannons across the web. The air cannons forcefully direct chopped fibers to the web and thereby overcome air turbulence within the forming hood and forces due to static electricity.

In accordance with one aspect of the invention, an air cannon for collecting chopped fibrous material and depositing received chopped fibers on a moving collection surface comprises an air amplifier defining a passage therethrough and having an inlet and an outlet. The air amplifier is driven by compressed air which enters the passage of the air amplifier through an air orifice. An outlet end of an inlet cone is positioned adjacent the inlet of the air amplifier with an inlet end of the inlet cone receiving chopped fibers and directing them to the air amplifier. An inlet end of an outlet cone is positioned adjacent the outlet of the air amplifier and an outlet end of the outlet cone directs chopped fibers onto the moving collection surface. In a working embodiment of the invention, the inlet and outlet cones are shaped as a frustum of a circular cone, and the inlet end of the inlet cone is larger than the outlet end of the inlet cone while the outlet end of the outlet cone is larger than the inlet end of the outlet cone.

The air amplifier has a minimum inside diameter and the outlet end of the inlet cone preferably is sized between about 0.75 times the minimum inside diameter and 1.25 times the minimum inside diameter. The outlet end of the inlet cone preferably is also spaced from the air orifice by a distance ranging from about 1/32 inch (0.8 mm) to about ½ inch (12.7 mm). The outlet of the air amplifier has a minimum outside diameter and the inlet end of the outlet cone is sized between about 1.00 times the minimum outside diameter and 1.25 times the minimum outside diameter. Axes A of symmetry of the air amplifier, the inlet cone and the outlet cone are in substantial alignment with one another, preferably with the axes A of symmetry of the air amplifier, the inlet cone and the outlet cone being in alignment with one another within about 0.125 inch. For proper ingestion of the chopped fibers by an air cannon, the substantially aligned axes A of symmetry of the inlet cone, the air amplifier and the outlet cone are within 45° of a velocity vector of chopped fibers as the fibers are discharged from a source of chopped fibers.

In accordance with another aspect of the invention, apparatus for collecting chopped fibrous material and depositing received chopped fibers on a moving collection surface comprises at least one bank of air cannons mounted across the moving collection surface. The bank comprises at least one and preferably a plurality of air cannons which are positioned relative to one another to reduce interference therebetween. In a working embodiment of the invention, to reduce interference between adjacent air cannons of a plurality of air cannons, the apparatus further comprises a plurality of generally L-shaped rods for mounting the plurality of air cannons. The L-shaped rods are formed to direct alternate air cannons up-line and down-line relative to movement of the moving collection surface. The L-shaped rods have generally horizontal legs mounted to a support frame and generally vertical legs with the air cannons secured thereto. To effect the alternating up-line/down-line direction of the air cannons, the L-shaped rods have alternating acute and obtuse angles between their generally horizontal and generally vertical legs.

The generally horizontal legs of the mounting rods are mounted for rotation in the support frame for movement of the air cannons in the cross direction of the moving collection surface. Adjustment arms are secured to the generally horizontal legs for adjusting the rotational position of the generally horizontal legs of the L-shaped rods and hence the vertical legs and air cannons secured thereto. Locking devices are associated with the adjustment arms for locking the adjustment arms and hence the generally horizontal legs in preferred rotational positions. In a working embodiment, the locking devices comprise eye bolts passing through oblong holes in the adjustment arms and cam levers pivotally mounted to the eye bolts. The cam levers are moved to one position to release the adjustment arms for movement of the adjustment arms within limits defined by the oblong holes and the eye bolts. In a locked position, the cam levers secure the adjustment arms to the support frame for maintaining adjustments of the mounting rods and thereby cross direction positioning of the air cannons.

In accordance with yet another aspect of the invention, a process for forming a chopped strand mat comprises the steps of: chopping strands of fibrous material; passing chopped strands through at least one air cannon to disperse the chopped strands and force the chopped strands against a moving collection surface; applying a binder to the chopped strands; applying energy to activate the binder; compacting the combination of activated binder and chopped strands; and, cooling the combination of activated binder and chopped fibers to form a continuous chopped strand mat. The method may further comprise the step of rolling up the continuous chopped strand mat to form a package. The step of passing chopped strands through at least one air cannon to disperse the chopped strands and force the chopped strands against a moving collection surface may comprise the step of passing chopped strands through at least two air cannons and the method further comprises the step of orienting alternate ones of the at least two air cannons up-line and down-line relative to the moving collection surface. To more evenly distribute chopped fibers on the collection surface, the method may further comprise the step of mounting the at least two air cannons for movement to selectively direct each of the at least two air cannons within a range across the moving collection surface.

In accordance with still another aspect of the present invention, a method for collecting chopped fibrous material and depositing received chopped fibers on a moving collection surface comprises the steps of: collecting chopped fibers in an inlet cone having an inlet end for receiving chopped fibers and an outlet end; directing collected chopped fibers from the outlet end of the inlet cone into an inlet of an air amplifier; and, dispersing fibers from an outlet of the air amplifier through an outlet cone onto the moving collection surface.

It is, thus, an object of the methods and apparatus of the present invention to provide improved deposition of chopped fibers on a moving collection surface for processing the resulting mat of chopped fibers into a chopped strand mat; to provide improved deposition of chopped fibers on a moving collection surface by an air cannon including an inlet cone, an air amplifier and an outlet cone; to provide improved deposition of chopped fibers on a moving collection surface using at least one bank of air cannons mounted across the surface; and, to provide improved deposition of chopped fibers on a moving collection surface using at least one bank of air cannons mounted across the surface wherein alternate air cannons within the at least one bank of air cannons are directed up-line and down-line to reduce interference between the air cannons which are adjustable in the cross direction.

Other objects and advantages of the invention will be apparent from the following description, the accompanying drawings and the appended claims.

DETAILED DESCRIPTION AND PREFERRED EMBODIMENTS OF THE INVENTION

Figure 1:
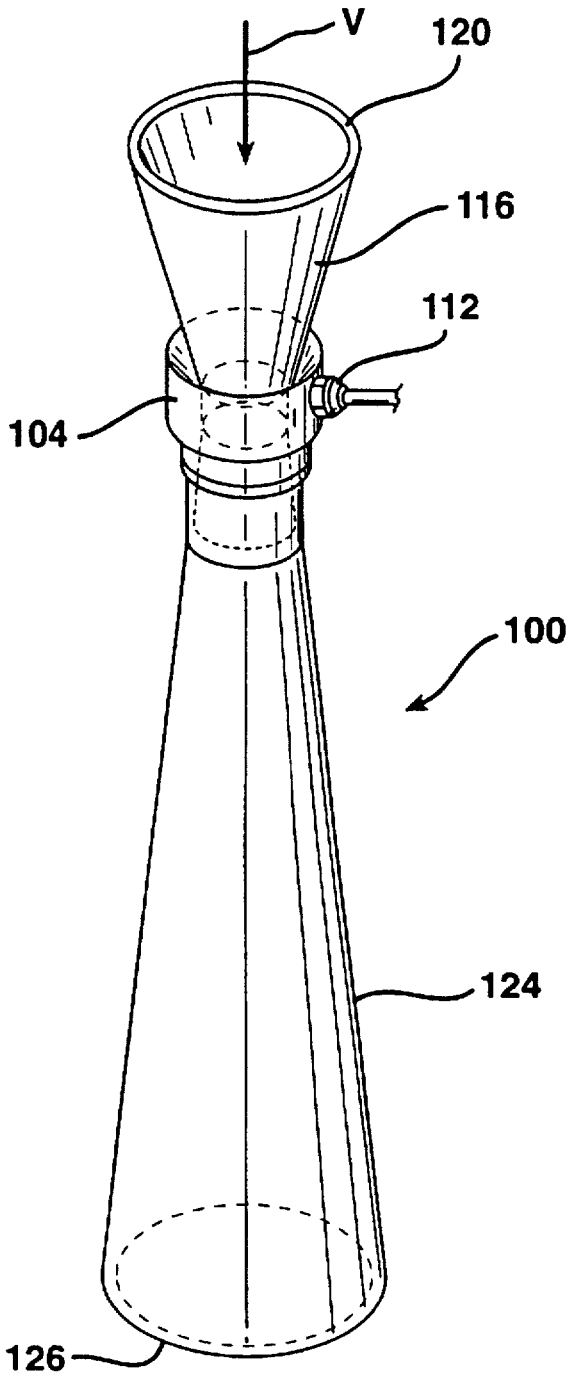
FIG. 1 is a perspective view of an air cannon operable in accordance with the present invention.
Figure 2:
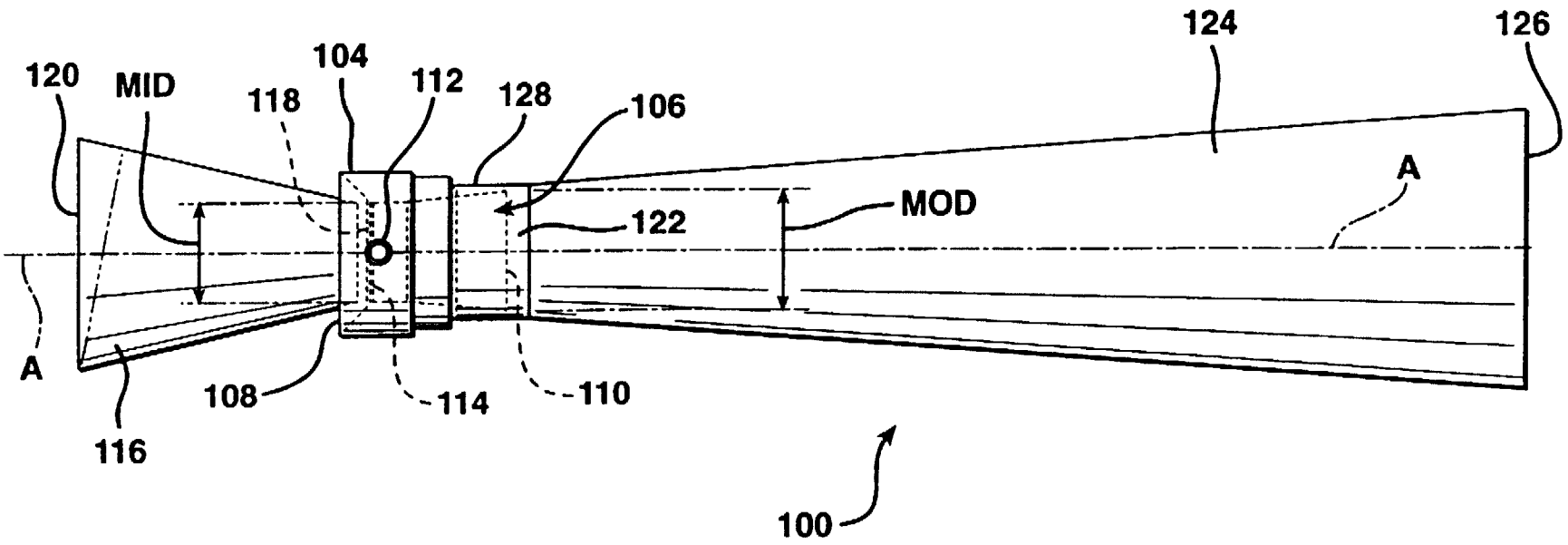
FIG. 2 is an elevational view of the air cannon of FIG. 1.

Reference will now be made to the drawings wherein FIGS. 1 and 2 illustrate an air cannon 100 which, alone or in banks of air cannons 100, collects chopped fibrous material, such as chopped glass fibers, and deposits received chopped fibers on a moving collection surface 102 as shown in FIGS. 3–5 and 9. The air cannon 100 comprises a pneumatically powered air amplifier 104 which defines a passage 106 therethrough and has an inlet 108 and an outlet 110. The air amplifier 104 is driven by compressed air injected into an air inlet 112 from a source of compressed air 113, see FIG. 5, with the compressed air passing through the inlet 112 into an annular chamber 112*a* and out into the passage 106 of the air amplifier 104 at high velocity through an air orifice 114, see FIG. 2A.

The compressed air defines a primary air stream 112*b* which adheres to an annular Coanda profile 112*c* defined by a portion of the inner surface 104*a* of the air amplifier 104. A low pressure area 104*b* is created by the primary stream 112*b* inducing a high volume flow of ambient air into the air amplifier 104. Air amplifiers which can be used as the air amplifier 104 are commercially available from a number of sources. For a working embodiment of the invention of the present application, an air amplifier purchased from the Exair Corporation of Cincinnati, Ohio and identified by model number 6034 was operated by a compressed air supply regulated between 20 PSIG and 100 PSIG.

Referring again to FIGS. 1 and 2, the air cannon 100 includes an inlet cone 116 having an outlet end 118 positioned adjacent the inlet 108 of the air amplifier 104 and an inlet end 120 larger than the outlet end 118. The inlet end 120 of the inlet cone 116 receives chopped fibers and directs them to the air amplifier 104. An inlet end 122 of a diffuser or outlet cone 124 is positioned adjacent the outlet 110 of the air amplifier 104 with an outlet end 126 of the outlet cone 124 directing chopped fibers onto the moving collection surface 102. The inlet cone 116 and the outlet cone 124 are preferably constructed as frustums of circular cones from nitrided stainless steel to extend their longevity. Other geometrically shaped cones can be used in the present invention as should be apparent.

Figure 2A:
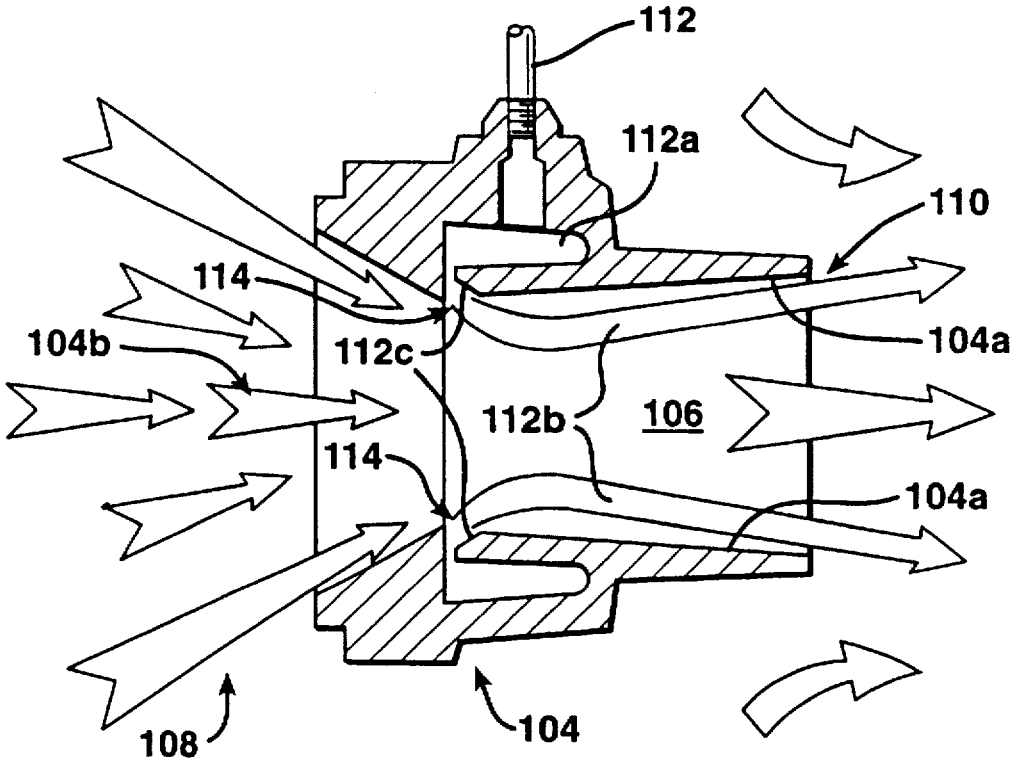
FIG. 2A is a cross-sectional view of an air amplifier of FIGS. 1 and 2.

As shown in FIGS. 1, 2, 6 and 7, preferably the inlet cone 116 is not attached directly to the air amplifier 104 and is sized and positioned to guide received chopped fibers into the inlet region of the air amplifier 104 to reduce abrasive wear to the inner surface 104*a*, see FIG. 2A, of the air amplifier 104 by reducing the impact of chopped fibers on passage 106 of the air amplifier 104. The inlet 108 of the air amplifier 104 has a minimum inside diameter MID and the outlet end 118 of the inlet cone 116 is preferably sized between about 0.75 times the minimum inside diameter MID of the air amplifier 104 and 1.25 times the minimum inside diameter MID of the air amplifier 104. The angle of the sidewalls of the inlet cone 116 can vary between approximately 0° and 45° relative to an axis A of the inlet cone 116. Also, the outlet end 118 of the inlet cone 116 is preferably spaced from the air orifice 114 by a distance ranging from about 1/32 inch (0.8 mm) to about ½ inch (12.7 mm).

The outlet 110 of the air amplifier 104 has a minimum outside diameter MOD and the inlet end 122 of the outlet cone 124 is preferably sized between about 1.00 times the minimum outside diameter MOD of the air amplifier 104 and 1.25 times the minimum outside diameter MOD of the air amplifier 104. As illustrated, the outlet cone 124 includes an extension 128 which fits over at least a portion of the end of the air amplifier 104 which defines the outlet 110. However, other mounting arrangements are possible, for example, the outlet cone 124 can be mounted such that the inlet 122 of the outlet cone 124 is spaced up to approximately 1.5 inches (3.81 cm) from the outlet 110 of the air amplifier 104. The angle of the sidewalls of the outlet cone 124 can vary between approximately 0 and 10 relative to an axis A of the outlet cone 116.

The axes A of symmetry of the air amplifier 104, the inlet cone 116 and the outlet cone 124 are in substantial alignment with one another. As illustrated in FIG. 2, the axes A of symmetry are in complete alignment. While such alignment is preferred, the air cannon 100 operates properly if the axes A of symmetry of the inlet cone 116 and the outlet cone 124 are in alignment within about 0.125 inch (3.2 mm) of the axis A of symmetry of the air amplifier 104. Proper operation of the air cannon 100 has been observed in a working embodiment of the invention if the substantially aligned axes A of symmetry of the air amplifier 104, the inlet cone 116 and the outlet cone 124 are within about 45° of a velocity vector V, see FIG. 1, of chopped fibers as the fibers are discharged from a source of chopped fibers, such as a fiber chopper, and the inlet end 120 of the inlet cone 116 is located within approximately 18 inches (45.7 cm) of the discharge from the fiber chopper.

When compressed air is supplied to the air amplifier 104, chopped fibers and ambient air are drawn into the inlet cone 116. The inlet cone 116 guides the ambient air and fibers into the throat of the air amplifier 104 substantially reducing the number of fibers which impact the air amplifier 104 to reduce abrasive wear and extend the service life of the air amplifier 104. The air amplifier 104 produces the motive force to convey air and chopped fibers through the air cannon 100. The outlet cone 124 controls the deceleration and diffusion of the air and chopped fiber flowing from the air amplifier 104. The outlet end 126 of the outlet cone 124 is aimed at the moving collection surface 102 to direct chopped fibers onto the surface 102. Turbulent air flow and static forces are overpowered by using the air cannon 100 such that chopped fibers are evenly deposited on the collection surface 102 and static suppression equipment is not needed.

Figure 3:
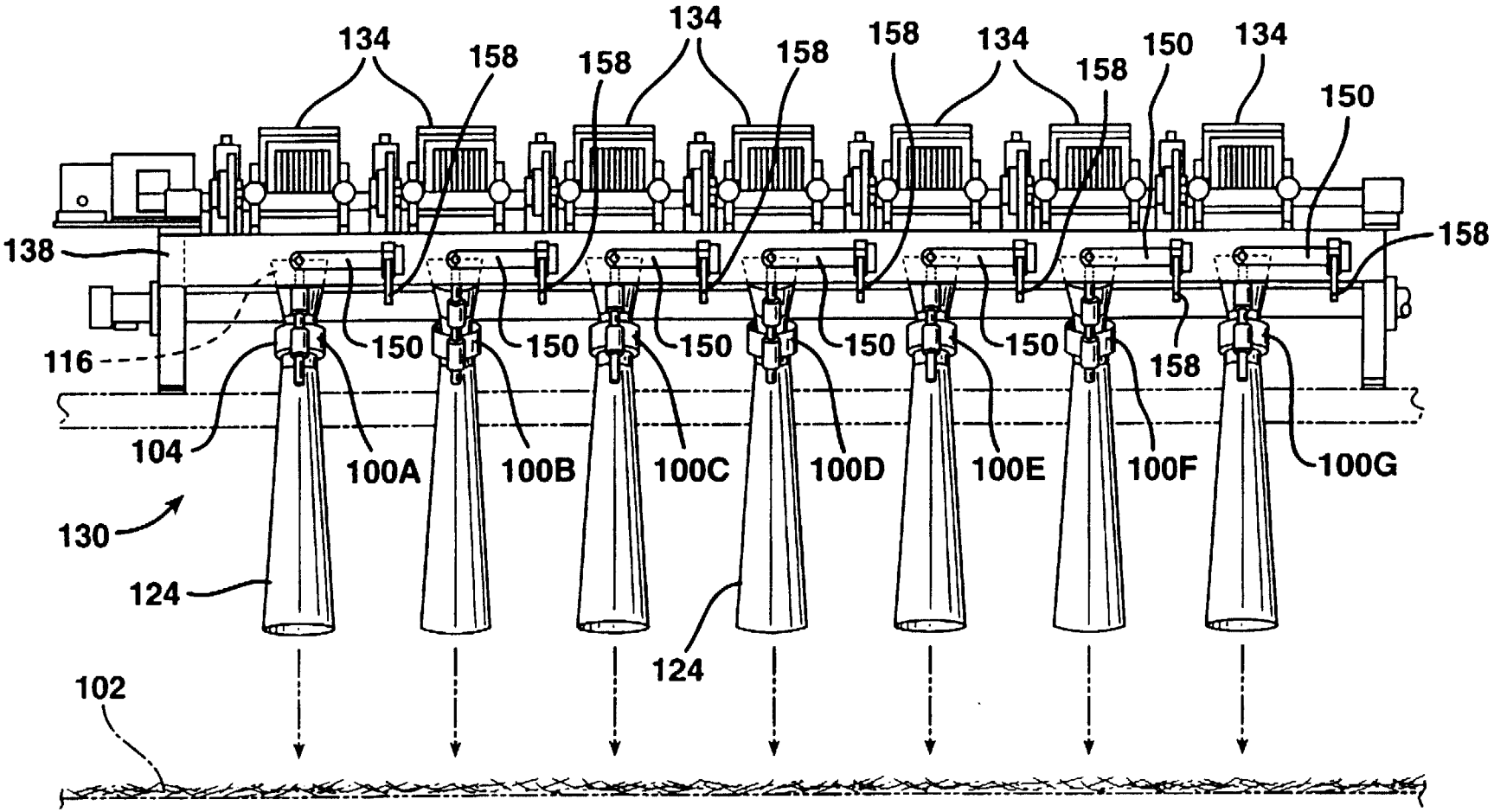
FIGS. 3, 4 and 5 are front, top and side views, respectively, of apparatus including a bank of air cannons as illustrated in FIGS. 1 and 2.
Figure 4:
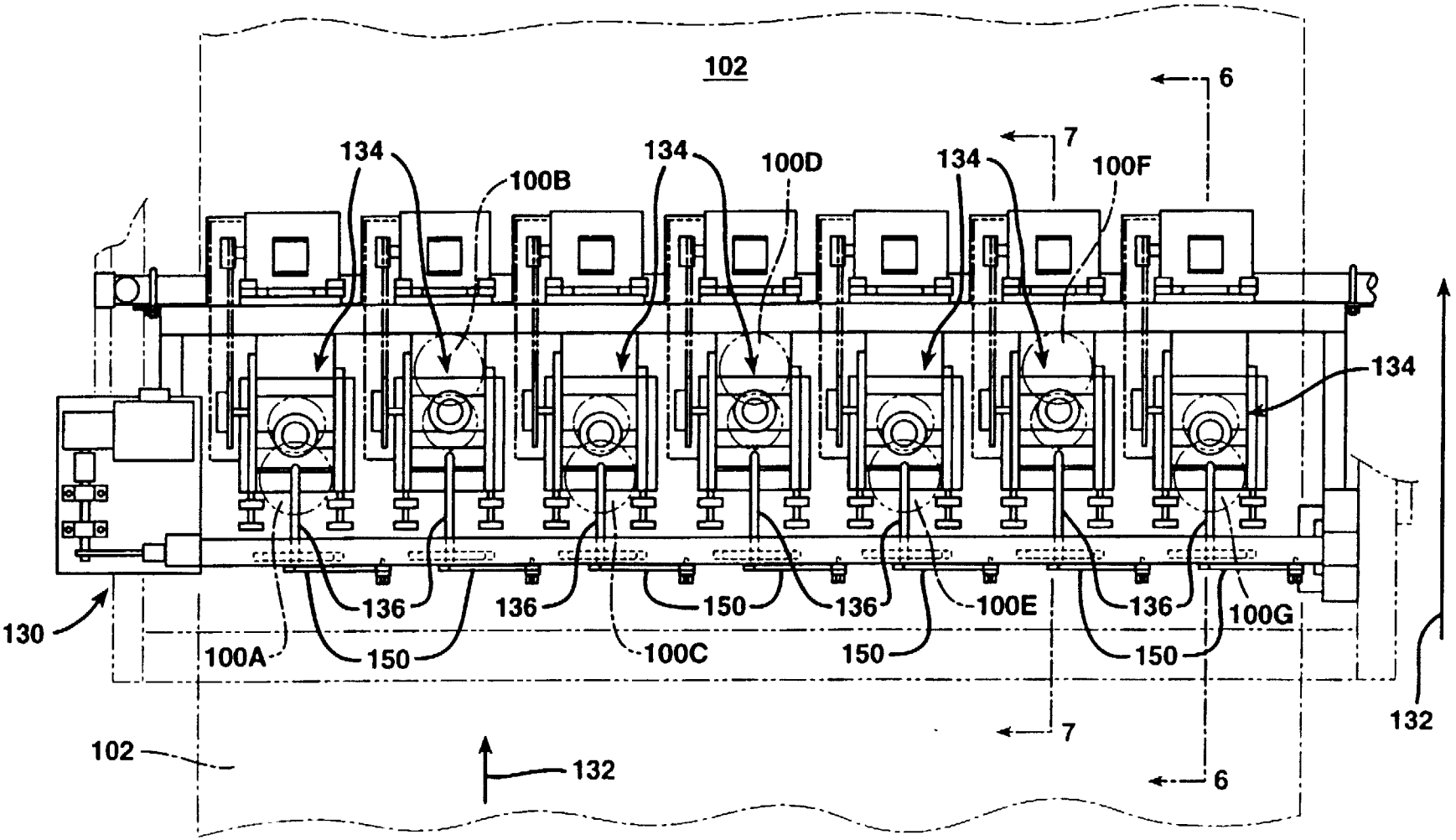

To deposit chopped fibers across a wide moving collection surface, such as the surface 102, at least one bank 130 of air cannons 100 are mounted across the surface 102, see FIGS. 3 and 4. One or more additional banks 130 of air cannons 100 can be provided to increase the thickness of the mat of chopped fibers deposited on the surface 102 with two banks of air cannons 130 being shown in the machine schematically illustrated in FIG. 9. While a bank can comprise a single air cannon with a series of banks stepped or staggered across the surface 102, preferably the bank 130 comprises a plurality of air cannons 100 which are mounted in-line across the surface 102 and positioned relative to one another to reduce interference therebetween. As illustrated in FIGS. 3 and 4, seven air cannons 100 are included in the bank 130, of course more or less than seven air cannons can be used in a bank depending upon the size of the surface 102 and the air cannons.

Figure 9:
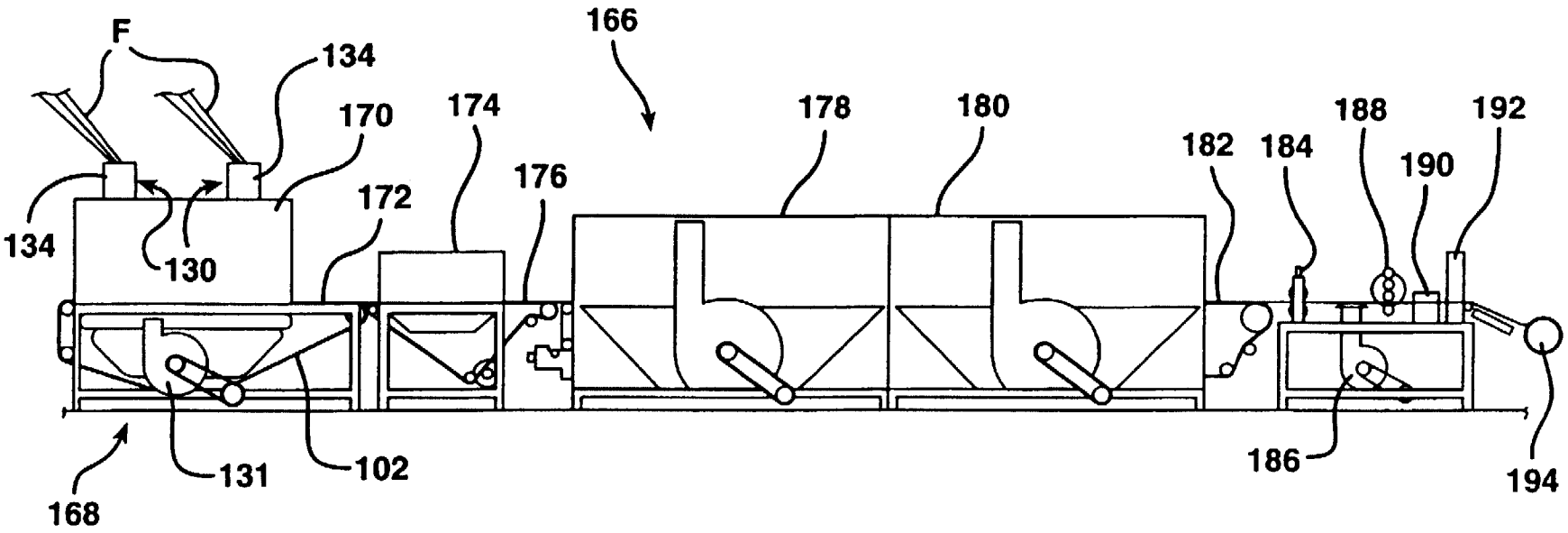
FIG. 9 is a schematic side view of a machine for making chopped strand mat in accordance with the present invention.

The moving collection surface 102 is foraminous and air is drawn through the surface 102 for example by a blower 131, see FIG. 9, to somewhat assist in deposition of chopped fibers on the surface 102 and more importantly to carry away air received from the air cannons 100. The surface 102 moves from up-line of the bank 130 to down-line of the bank 130 as indicated by an arrow 132, see FIGS. 4 and 5. For the bank 130 of seven air cannons 100 illustrated in FIGS. 3 and 4, four of the air cannons 100A, 100C, 100E, 100G are aimed up-line and three of the air cannons 100B, 100D, 100F are aimed down-line to reduce interference between the flows of air and chopped fibers from the air cannons 100. Fibers F are fed into fiber choppers 134 as shown in FIGS. 5 and 9 in a conventional manner with one fiber chopper 134 being provided for each air cannon 100, see FIGS. 3 and 4.

Figure 5:
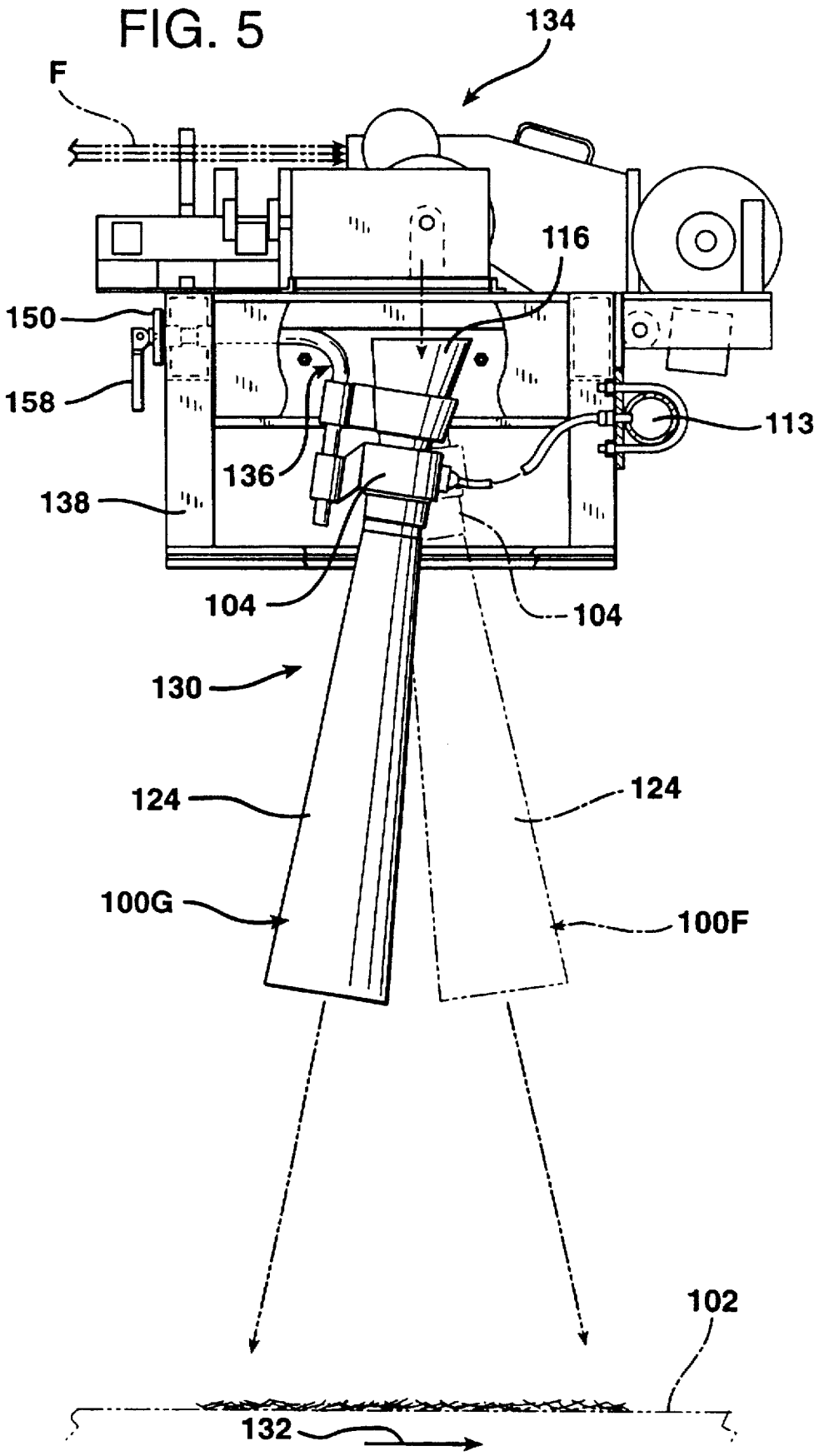
Figure 6:
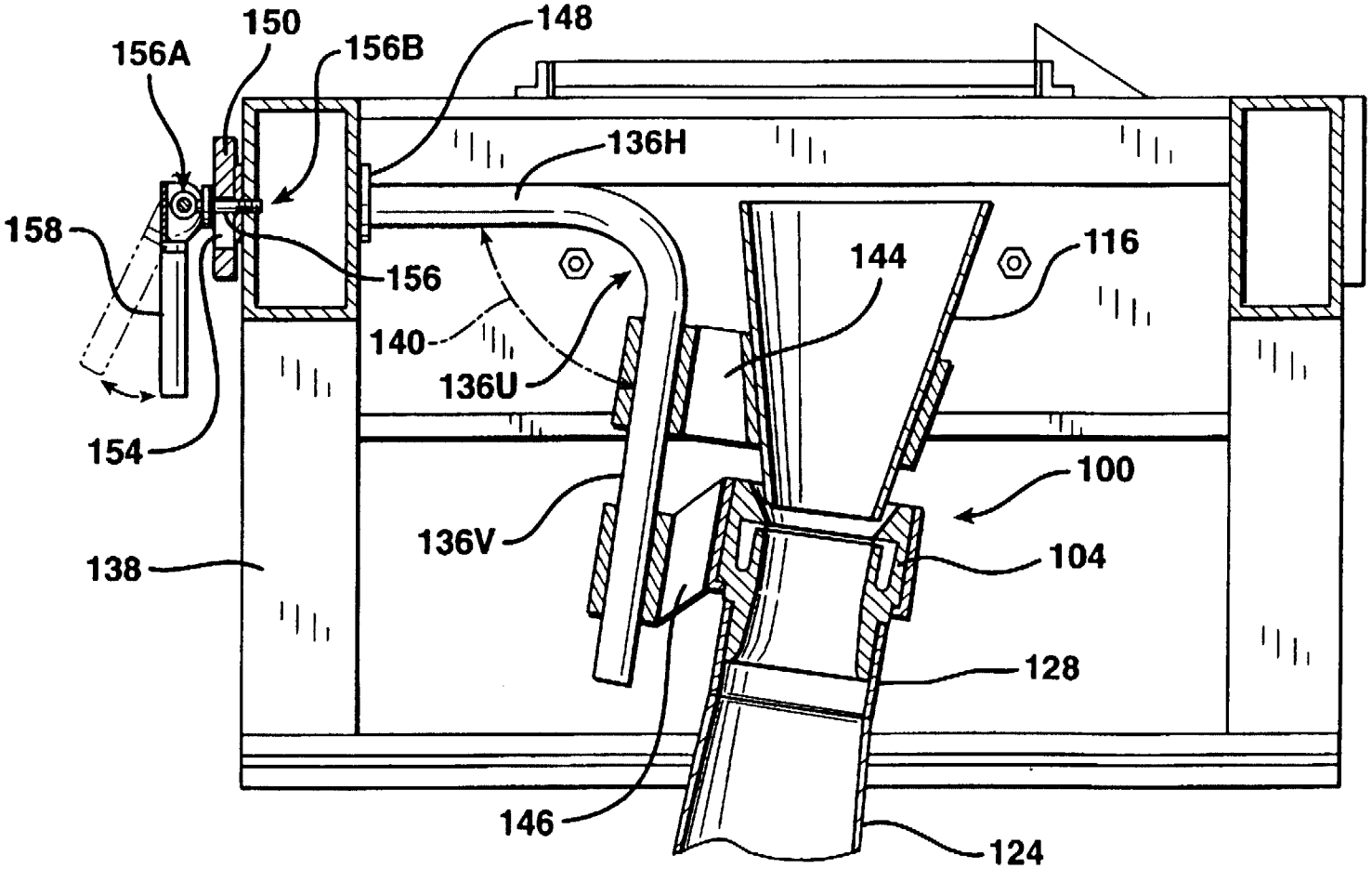
FIG. 6 is a cross-sectional view through an up-line directed air cannon of the bank of air cannons shown in FIGS. 3–5 taken along the section line 6–6.
Figure 7:
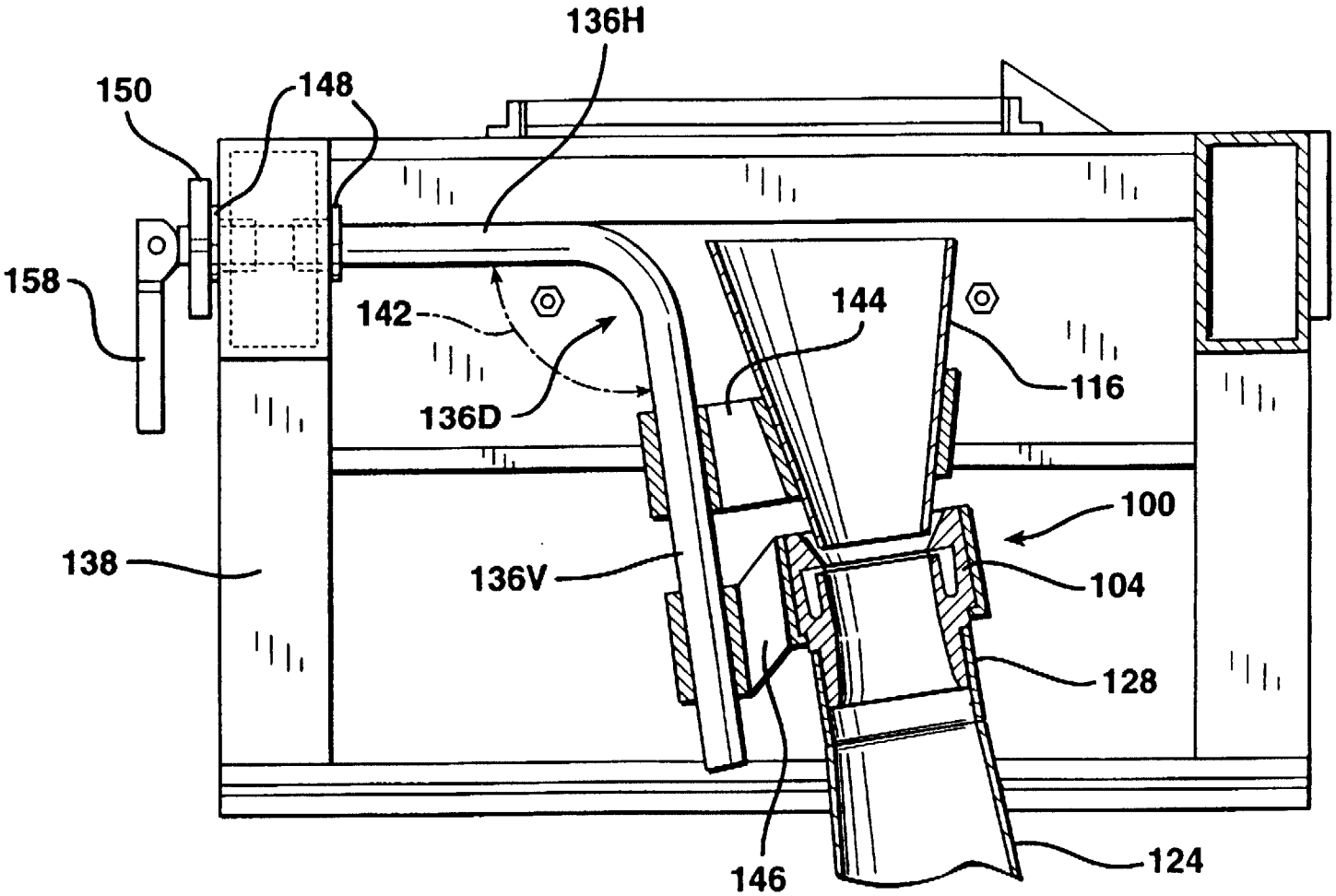
FIG. 7 is a cross-sectional view through a down-line directed air cannon of the bank of air cannons shown in FIGS. 3–5 taken along the section line 7–7.

Referring now to FIGS. 5–7, the up-line and down-line aiming of the air cannons 100 is accomplished by mounting the air cannons 100 on generally L-shaped rods 136 made of steel and having generally horizontal legs 136H pivotally mounted to a support frame 138 and generally vertical legs 136V with the air cannons 100 secured to the generally vertical legs 136V. The L-shaped rods 136 have alternating acute and obtuse angles between their horizontal and vertical legs to direct alternate ones of the air cannons up-line and down-line. As shown in FIG. 6, an L-shaped rod 136U includes an acute angle 140 between its horizontal and vertical legs 136H, 136V such that the air cannon 100 mounted thereto is directed up-line, see FIGS. 3–5. FIG. 7 illustrates an L-shaped rod 136D which includes an obtuse angle 142 between its horizontal and vertical legs 136H, 136V such that the air cannon 100 mounted thereto is directed down-line, see FIGS. 3–5.

The separation of the inlet cone 116 from the air amplifier 104 is clearly illustrated in FIGS. 6 and 7 wherein the inlet cones 116 of the air cannons 100 are supported directly from the generally vertical legs 136V of the L-shaped rods 136 by brackets 144 extending between the legs 136V and the inlet cones 116. The air amplifier 104 and outlet cone 124, which is secured to the air amplifier 104, are similarly supported from the generally vertical legs 136V of the L-shaped rods 136 by brackets 146. The inlet ends 120 of the inlet cones 116 of the air cannons 100 can be formed at right angles relative to the respective axes A of symmetry of the inlet cones 116 or can be angularly oriented relative to the axes A, for example to make the inlet ends 120 generally horizontally oriented. Further, the inlet ends 120 can be beveled or rolled outwardly. It is currently preferred to make the inlet ends 120 for the air cannons 100 square to the axes A of symmetry of the inlet cones 116 and rolled outwardly.

Figure 8:
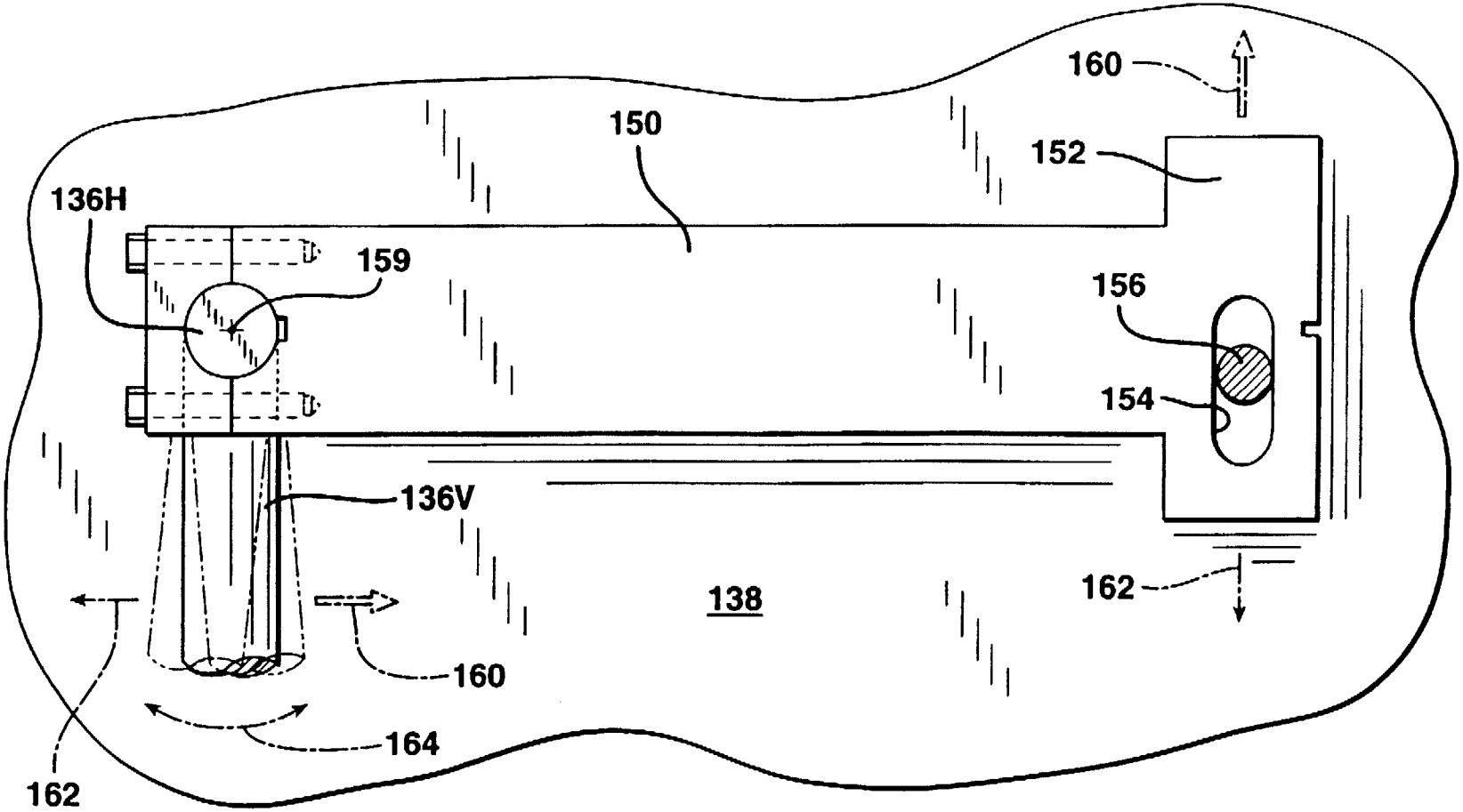
FIG. 8 illustrates an adjustment arm for adjusting the cross-mat positioning of the air cannons shown in FIGS. 3–5.

In addition to the up-line and down-line alternation of the air cannons 100, each of the air cannons 100 can be moved in the cross direction or from side-to-side as shown in FIGS. 3 and 4. This side-to-side or cross-mat movement of the air cannons 100 is performed by rotating the generally horizontal legs 136H in bearings 148 which provide the pivotal mounting of the generally L-shaped rods 136 to the support frame 138. To this end, a first end of an adjustment arm 150 is secured and preferably keyed to the ends of each of the generally horizontal legs 136H, see FIG. 8. A second end of each adjustment arm 150 terminates in an adjustment plate 152 which includes an oblong slot 154 formed therein.

An eye bolt 156 having an eye 156A on one end and threads 156B on the other end is passed through the slot 154 and threaded into a threaded bore appropriately located on the support frame 138, see FIG. 6. A cam lever 158, see FIGS. 3, 5, 6 and 7, is mounted for pivotal movement to the eye 156A of the eye bolt 156. When the cam lever 158 is raised, the adjustment arm 150 can be moved upward or downward about an axis 159 with its movement being limited by the ends of the slot 154 engaging the eye bolt 156. For upward movement of the adjustment arm 150, the generally vertical leg 136V moves to the right as indicated by arrows 160, and for downward movement of the adjustment arm 150, the generally vertical leg 136V moves to the left as indicated by arrows 162, see FIG. 8. Once the adjustment arm 150 is positioned such that the air cannon 100 is aimed as desired, the cam lever 158 is lowered to lock the adjustment arm 150 to the support frame 138. As should be apparent, the generally vertical legs 136V and hence the air cannons 100 can thus be adjusted back and forth relative to the surface 102 in a generally arcuate motion as indicated by double-headed arrow 164, see FIG. 8.

Reference will now be made to FIG. 9 which schematically illustrates a machine 166 for making chopped strand mat in accordance with the present invention. A station 168 includes two banks 130 of air cannons 100 represented by the fiber choppers 134 which receive and chop fibers F and pass chopped fibers to the air cannons 100 as described above. The air cannons 100 are not shown but are positioned within the forming hood 170 of the station 168.

A mat 172 of chopped fibers as deposited on the moving collection surface 102 is passed to a binder depositor 174 wherein a binder is applied to the mat 172 of chopped fibers. For example, for a powder mat, the binder may be powdered unsaturated polyester having a glass transition point from approximately 95° F. to 160° F., preferably between about 105° F. to 120° F., which is applied to the mat 172; and, for an emulsion mat, the binder may be a liquid polyvinyl acetate emulsion which is sprayed onto the mat 172.

The resulting binder treated mat 176 is passed through apparatus for applying energy, for example heat applied by ovens 178, 180 as illustrated in FIG. 9, to activate the binder, i.e., to liquify a powder thermoplastic binder, to drive off the water from an aqueous binder or to effect curing of a thermosetting binder. It is noted that for production of a mat using an aqueous binder, the application of energy, such as heat, may not be required since the mat may be air dried; however, for faster drying it is preferred. The resulting chopped strand mat 182 is then passed through compacting/cooling rollers 184, after which it is further cooled by a cooling fan 186.

The chopped strand mat may then be passed through slitters 188 which cut the chopped strand mat to desired widths, feed rollers 190 and a cutter 192 which cuts the continuous mat into appropriate package lengths. Finally, the chopped strand mat is rolled up to form a roll package 194. Those desiring additional details regarding the production of chopped strand mat and the like, which are well known by those skilled in the art, can be determined by reference to *The Manufacturing Technology of Continuous Glass Fibres*, Second edition, by K. L. Loewenstein, published by Elsevier in 1983 which is incorporated herein by reference. It is noted that any type of appropriate process may be employed down-line of the station 168 to form chopped strand mat from the mat 172 which is produced by the station 168.

Having thus described the invention of the present application in detail and by reference to preferred embodiments thereof, it will be apparent that modifications and variations are possible without departing from the scope of the invention defined in the appended claims.

What is claimed:

1. An air cannon (100) for collecting chopped fibrous material and depositing received chopped fibers on a moving collection surface (102), said air cannon (100) comprising:

an air amplifier (104) defining a passage (106) therethrough and having an inlet (108) and an outlet (110), said air amplifier (104) being driven by compressed air which enters said passage of said air amplifier (104) through an air orifice (114);

an inlet cone (116) having an outlet end (118) positioned adjacent said inlet (108) of said air amplifier (104) and an inlet end (120) for receiving chopped fibers and directing them to the air amplifier (104); and an outlet cone (124) and having an inlet end (122) positioned adjacent said outlet (110) of said air amplifier (104) and an outlet end (126) for directing chopped fibers onto said moving collection surface (102).

2. An air cannon (100) as claimed in claim 1 wherein said inlet end (120) of said inlet cone (116) is larger than said outlet end (118) of said inlet cone (116) and said outlet end (126) of said outlet cone (124) is larger than said inlet end (122) of said outlet cone (124).

3. An air cannon (100) as claimed in claim 1 wherein said inlet cone (116) and said outlet cone (124) are shaped as a frustum of a circular cone.

4. An air cannon (100) as claimed in claim 3 wherein said inlet (108) of said air amplifier (104) has a minimum inside diameter (MID) and said outlet end (118) of said inlet cone (116) is sized between about 0.75 times said minimum inside diameter and 1.25 times said minimum inside diameter.

5. An air cannon (100) as claimed in claim 3 wherein said outlet (110) of said air amplifier (104) has a minimum outside diameter and said inlet end (122) of said outlet cone (124) is sized between about 1.00 times said minimum outside diameter and 1.25 times said minimum outside diameter.

6. An air cannon (100) as claimed in claim 1 wherein said outlet end (118) of said inlet cone (116) is spaced from said air orifice (114) by a distance ranging from about 1/32 inch to about ½ inch.

7. An air cannon (100) as claimed in claim 6 wherein axes (A) of symmetry of said air amplifier (104), said inlet cone (116) and said outlet cone (124) are in substantial alignment with one another.

8. An air cannon (100) as claimed in claim 7 wherein said axes (A) of symmetry of said air amplifier (104), said inlet cone (116) and said outlet cone (124) are in alignment within about 0.125 inch.

9. An air cannon (100) as claimed in claim 8 wherein said substantially aligned axes (A) of symmetry are within 45 of a velocity vector (V) of chopped fibers as the fibers are discharged from a source (134) of chopped fibers.

10. Apparatus (130) for collecting chopped fibrous material and depositing received chopped fibers on a moving collection surface (102), said apparatus (130) comprising at least one air cannon (100).

11. Apparatus (130) as claimed in claim 10 wherein said apparatus comprises at least one bank (130) of air cannons (100) mounted across said moving collection surface (102), said bank (130) comprising a plurality of air cannons (100) which are positioned relative to one another to reduce interference therebetween.

12. Apparatus (130) as claimed in claim 11 further comprising a plurality of generally L-shaped rods (136) for mounting said plurality of air cannons (100) to direct alternate air cannons (100) up-line and down-line relative to movement of said moving collection surface (102) to thereby reduce interference between said plurality of air cannons (100), said L-shaped rods (136) having generally horizontal legs (136H) mounted to a support frame (138) and generally vertical legs (136V) with said air cannons (100) secured thereto, the L-shaped rods (136) having alternating acute and obtuse angles (140, 142) between their generally horizontal and generally vertical legs (136H, 136V) to direct alternate air cannons (100) up-line and down-line.

13. Apparatus (130) as claimed in claim 12 wherein said generally horizontal legs (136H) of said mounting rods (136) are mounted for rotation in said support frame (138) for movement of said air cannons (100) in the cross direction of said moving collection surface (102) and further comprise adjustment arms (150) secured to said generally horizontal legs (136H) for adjusting the rotational position of said generally horizontal legs (136H) of said L-shaped rods (136).

14. Apparatus (130) as claimed in claim 13 further comprising locking devices associated with said adjustment arms (150) for locking said adjustment arms (150) and hence said generally horizontal legs (136H) in preferred rotational positions.

15. Apparatus (130) as claimed in claim 14 wherein said locking devices comprise eye bolts (156) passing through oblong holes (154) in said adjustment arms (150) and cam levers (158) pivotally mounted to said eye bolts (156), said cam levers (158) in one position releasing said adjustment arms (150) for movement of said adjustment arms (150) within limits defined by said oblong holes (154) and said eye bolts (156), and in another position securing said adjustment arms (150) to said support frame (138) for maintaining adjustments of said mounting rods (136) and thereby cross direction positioning of said air cannons (100).

16. Apparatus (130) as claimed in claim 15 wherein each of said air cannons (100) comprises:

an air amplifier (104) defining a passage (106) therethrough and having an inlet (108) and an outlet (110), said air amplifier (104) being driven by compressed air which enters said passage (106) of said air amplifier (104) through an air orifice (114);

an inlet cone (116) having an outlet end (118) positioned adjacent said inlet (108) of said air amplifier (104) and an inlet end (120) larger than said outlet end (118) for receiving chopped fibers and directing them to the air amplifier (104); and an outlet cone (124) having an inlet end (122) positioned adjacent said outlet (110) of said air amplifier (104) and an outlet end (126) larger than said inlet end (122) of said outlet cone (124) for directing chopped fibers onto said moving collection surface (102).

17. Apparatus (130) as claimed in claim 16 wherein said outlet cone (124) is secured to said air amplifier (104) and said inlet cone (116) is secured to one of said vertical legs (136V) of one of said L-shaped rods (136) which supports the respective air cannon (100) such that said inlet cone (116) and said air amplifier (104) are not in direct contact with one another.

18. Apparatus (130) as claimed in claim 17 wherein said apparatus (130) comprises two banks (130) of air cannons (100) mounted across said moving collection surface (102).

19. A process for forming a chopped strand mat (182) comprising the steps of:

chopping strands of fibrous material (F);

passing chopped strands through at least one air cannon (100) to disperse said chopped strands and force said chopped strands against a moving collection surface (102);

applying a binder (174) to said chopped strands;

applying energy (178, 180) to activate said binder;

compacting (184) the combination of activated binder and chopped strands; and cooling (184, 186) the combination of activated binder and chopped fibers to form a continuous chopped strand mat.

20. A process for forming a chopped strand mat (182) as claimed in claim 19 further comprising the step of rolling up said continuous chopped strand mat to form a package (194).

21. A process for forming a chopped strand mat (182) as claimed in claim 20 wherein the step of passing chopped strands through at least one air cannon (100) to disperse said chopped strands and force said chopped strands against a moving collection surface (102) comprises the step of passing chopped strands through at least two air cannons (100) and further comprising the step of orienting alternate ones of said at least two air cannons (100) up-line and down-line relative to said moving collection surface (102).

22. A process for forming a chopped strand mat (182) as claimed in claim 21 further comprising the step of mounting said at least two air cannons (100) for movement to selectively direct each of said at least two air cannons (100) within a range across said moving collection surface (102) to thereby evenly distribute said chopped strands against said moving collection surface (102).

23. A method for collecting chopped fibrous material and depositing received chopped fibers on a moving collection surface (102), said method comprising the steps of:

collecting chopped fibers in an inlet cone (116) having an inlet end (120) for receiving chopped fibers and an outlet end (118);

directing collected chopped fibers from said outlet end (118) of said inlet cone (116) into an inlet (108) of an air amplifier (104); and dispersing fibers from an outlet (110) of said air amplifier (104) through an outlet cone (124) onto said moving collection surface (102).

* * * * *